US010131498B1

(12) United States Patent
Schairbaum

(10) Patent No.: US 10,131,498 B1
(45) Date of Patent: Nov. 20, 2018

(54) PORTABLE AIR-TIGHT WATER-TIGHT REUSEABLE TRASH RECEPTACLE

(71) Applicant: Ed Schairbaum, Willow Park, TX (US)

(72) Inventor: Ed Schairbaum, Willow Park, TX (US)

( * ) Notice: Subject to any disclaimer, the term of this patent is extended or adjusted under 35 U.S.C. 154(b) by 33 days.

(21) Appl. No.: 15/203,396

(22) Filed: Jul. 6, 2016

Related U.S. Application Data

(60) Provisional application No. 62/188,913, filed on Jul. 6, 2015.

(51) Int. Cl.
*B65F 1/06* (2006.01)
*B65F 1/16* (2006.01)

(52) U.S. Cl.
CPC ..... *B65F 1/1646* (2013.01); *B65F 1/06* (2013.01)

(58) Field of Classification Search
CPC ..... B65F 1/06; B65F 1/065; B65F 1/1646
USPC ..... 220/495.08, 908.1, 601, 582, 495.11; 383/33, 904, 121, 114, 111
See application file for complete search history.

(56) References Cited

U.S. PATENT DOCUMENTS 5,385,251 A * 1/1995 Dunn ..... A61J 9/001 215/11.1
5,882,119 A * 3/1999 Fadal, II ..... A45F 3/20 383/111
9,675,525 B2 * 6/2017 McBean ..... A61J 11/04
2008/0023478 A1 * 1/2008 Cahill ..... B65F 1/16 220/375
2008/0163965 A1 * 7/2008 McNelly ..... B65D 77/0406 150/165

* cited by examiner

*Primary Examiner* — Stephen Castellano
(74) *Attorney, Agent, or Firm* — James E. Walton

(57) ABSTRACT

A system and method for preventing leaks from rubbish containing liquids and noxious smells has an air-tight and water-tight reusable trash receptacle. The receptacle uses an inner ring and an outer ring to secure a trash bag. A gasketed lid provides a seal when the lid is engaged with the outer ring. A fabric cover attaches to the outer ring and protects and hides the trash bag held within.

1 Claim, 9 Drawing Sheets

PORTABLE AIR-TIGHT WATER-TIGHT REUSEABLE TRASH RECEPTACLE

This application claims priority to U.S. provisional application No. 62/188,913 filed Jul. 6, 2015.

BACKGROUND

1. Field of the Invention

The present application relates in general to the field of portable trash cans, more specifically, to trash cans featuring a hermetic seal to prevent migration of odors and contents of the trash can.

2. Description of Related Art

Current trash cans are typically an open vessel designed to hold up a plastic bag. The bag acts as a liner and the can acts as a support for the liner. Some trash cans have lids that rest on the top of the can to mitigate migration of aroma from the can. Portable trash cans, such as those for vehicles, are typically soft sided and configured to retain a trash bag. Lids for current portable trash receptacles rest on the lip of the trash can without the ability to prevent leakage if the receptacle is inverted or falls over. A need exists for portable trash receptacles that can retain liquids, odors, and noxious refuse no matter the orientation of the receptacle. While there are many ways to store trash well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
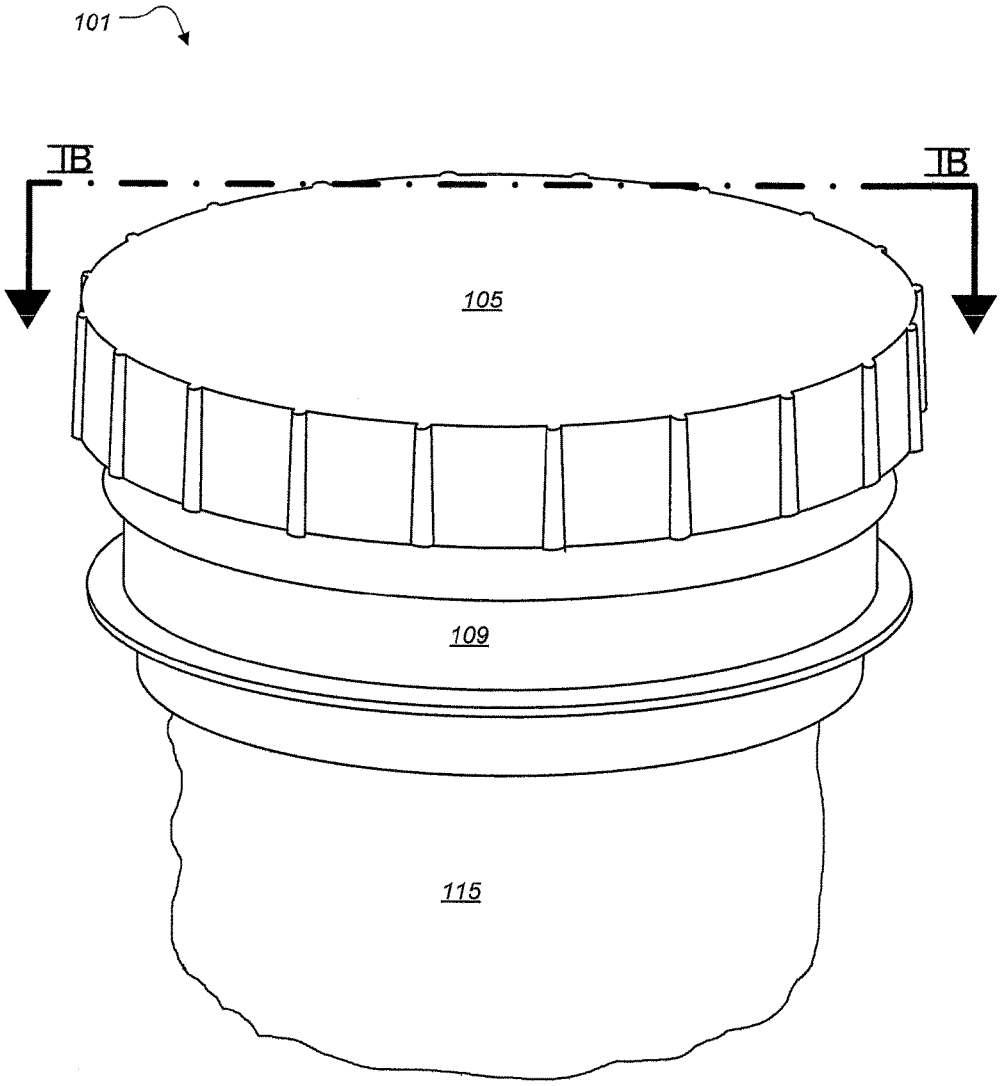
FIG. 1A is a perspective view of a portable air-tight water-tight reusable trash receptacle according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of a portable air-tight water-tight reusable trash receptacle are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A lidded trash receptacle is air-tight, water-tight, and prevents liquid contents and noxious fumes from escaping the receptacle. The receptacle includes a lid, a fabric cover, an outer ring, and an inner ring. The lidded receptacle allows a user to dispose of a six pack of soda, an ice cream cone, vomit, and or a baby diaper without worrying about the receptacle leaking liquids or gases.

Figure 1B:
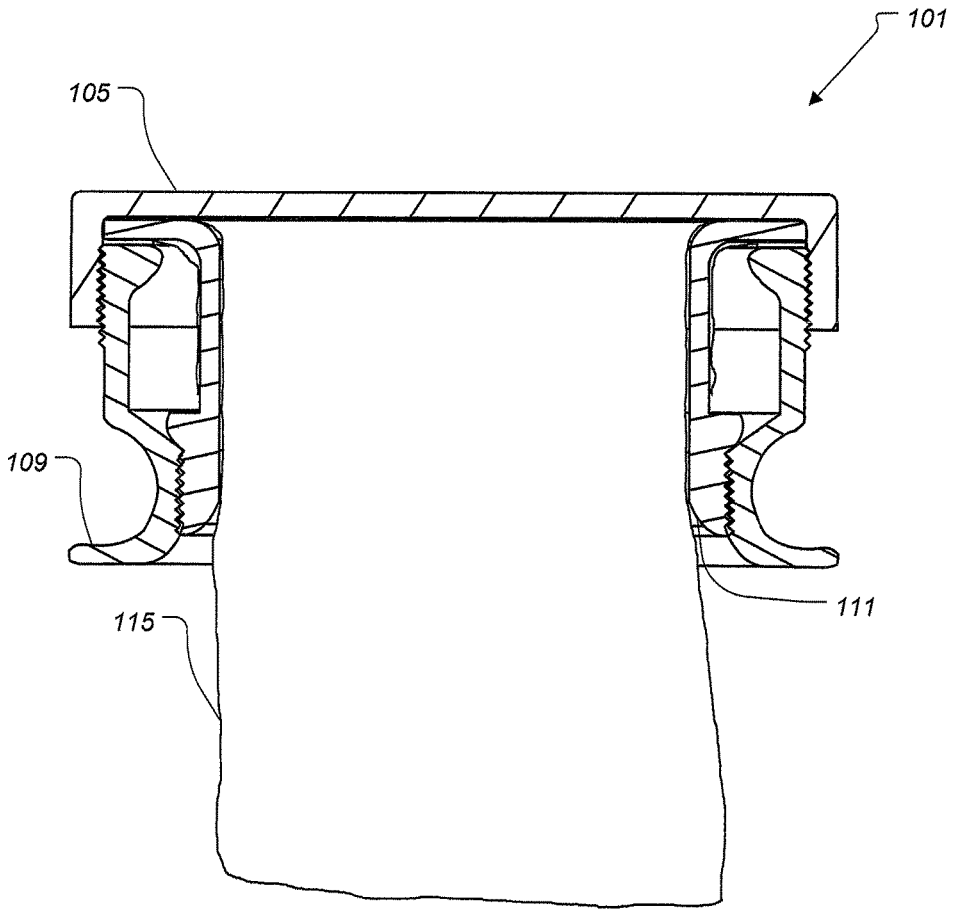
FIG. 1B is a cross section view of a portable air-tight water-tight reusable trash receptacle according to the present application.

Referring now to FIG. 1A, a perspective view of a portable air-tight water-tight reusable trash receptacle according to the present application is illustrated. Referring now also to FIG. 1*b* a cross section view, taken at line IB, of a portable air-tight water-tight reusable trash receptacle according to the present application is illustrated. Trash receptacle 101 is comprised of a lid 105, an outer ring 109, and an inner ring 111. A trash bag 115 is located between the outer ring 109 and the inner ring 111. Not shown is a fabric cover that is secured to the outer ring that protects the contents of the trash bag and prevents the contents of the trash bag 115 from being visible outside the receptacle.

Inner ring 111 is coupled to outer ring 109 by threading. A user would place the trash bag inside the inner ring 111 pulling the top of the trash bag 115 over the top of the inner ring into the region between the inner ring and the outer ring. The user would then screw the outer ring relative to the inner ring to secure the trash bag in place. Inner ring has a compressible ring, such as a rubber seal, located between the inner ring and the outer ring. Rubber seal provides friction between the trash bag 115 and the rings.

Lid 105 is coupled to the outer ring 109 by a threaded interface. Lid 105 uses a rubber seal located inside the lid to further seal the contents of the trash bag 115. A user can unscrew the lid from the outer ring and the trash bag is retained. Liquids and solids are contained inside the trash bag 115 and prevented from leaking by lid 105.

Figure 2A:
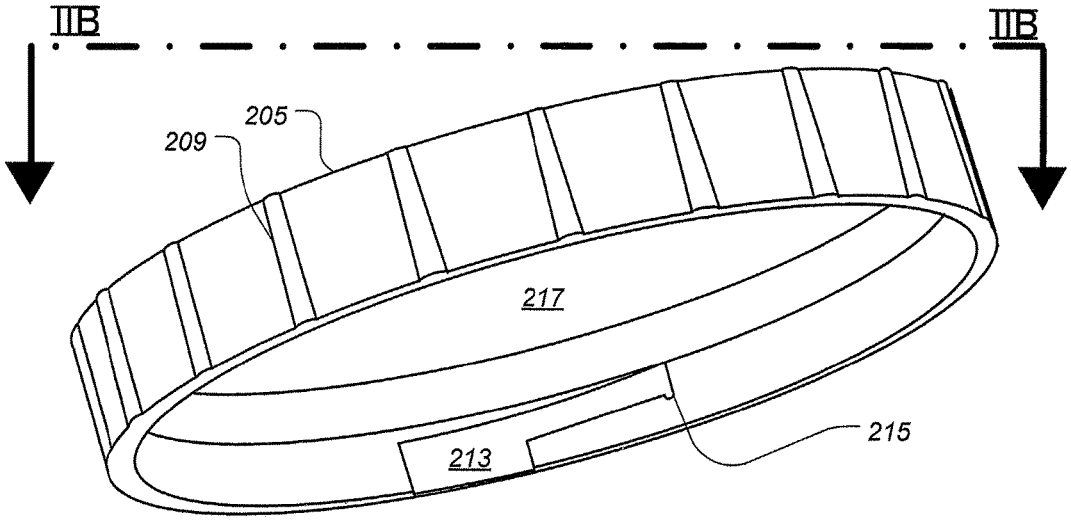
FIG. 2A is a perspective view of a lid for a portable air-tight water-tight reusable trash receptacle according to the present application.
Figure 2B:
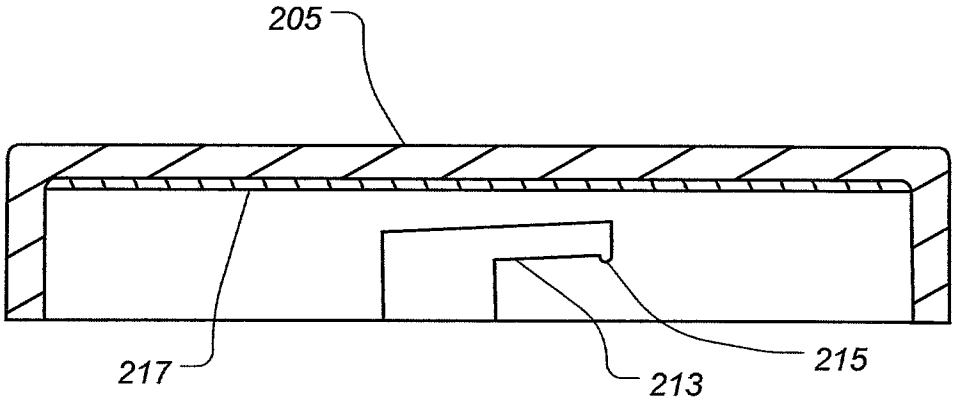
FIG. 2B is a cross section view of a lid for a portable air-tight water-tight reusable trash receptacle according to the present application.

Referring now to FIG. 2A, a perspective view of a lid for a portable air-tight water-tight reusable trash receptacle according to the present application is illustrated. Referring now also to FIG. 2B a cross section view, taken at line IIB, of a lid for a portable air-tight water-tight reusable trash receptacle according to the present application is illustrated. Lid 205 is similar to that of lid 105. Lid 205 uses a plurality of ridges 209 around the circumference of the lid to facilitate a user's grip on the lid. Additionally, lid 205 has a slot 213 or keyway for receiving a tab from the outer ring of the trash receptacle. Slot 213 uses notch 215 to lock the lid 205 in place by receiving a protrusion off the tab. Users of the lid 205 depress the lid and rotate to secure the tab of the outer ring into the slot 213. To remove the lid 205 from the receptacle the process is revered. Lid 205 uses a seal 217, preferably rubber, to keep the contents of the secured trash bag inside. Seal 217 is located inside the lid and engages the top of the outer ring.

Figure 3A:
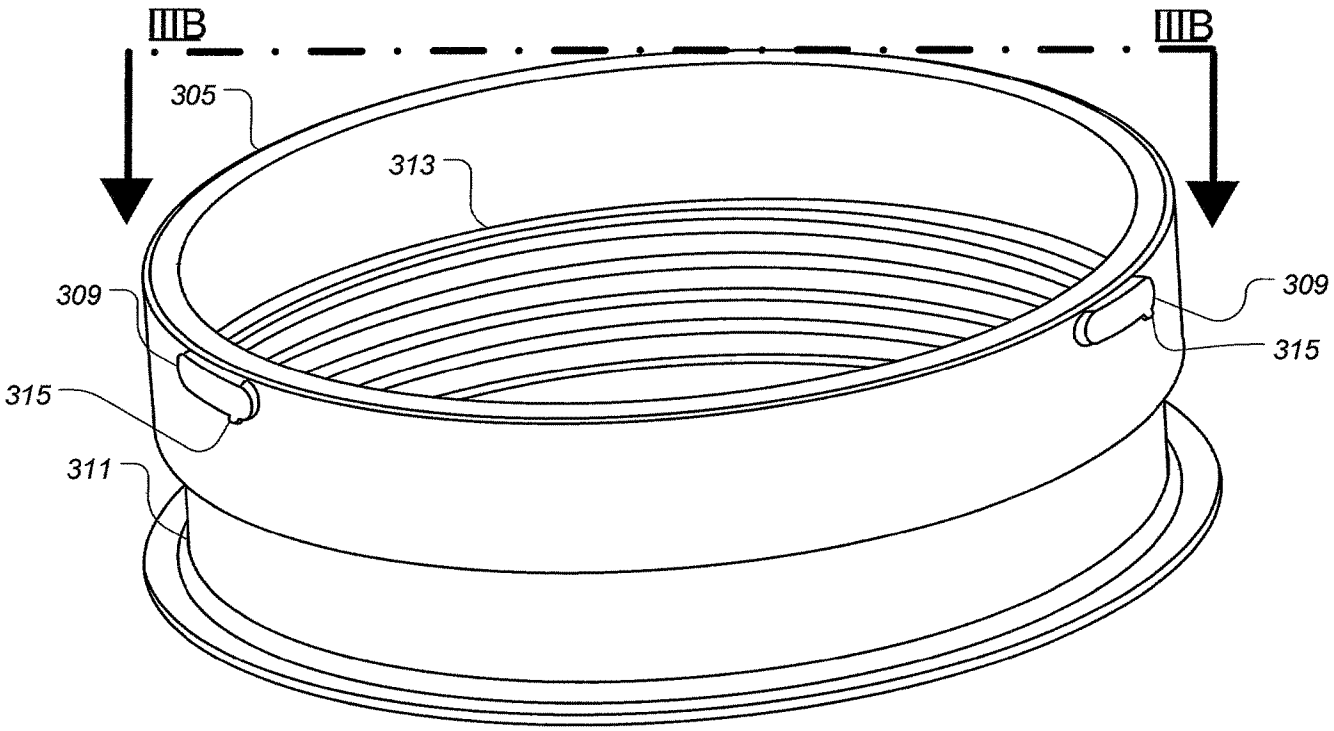
FIG. 3A is a perspective view of an outer ring for a portable air-tight water-tight reusable trash receptacle according to the present application.
Figure 3B:
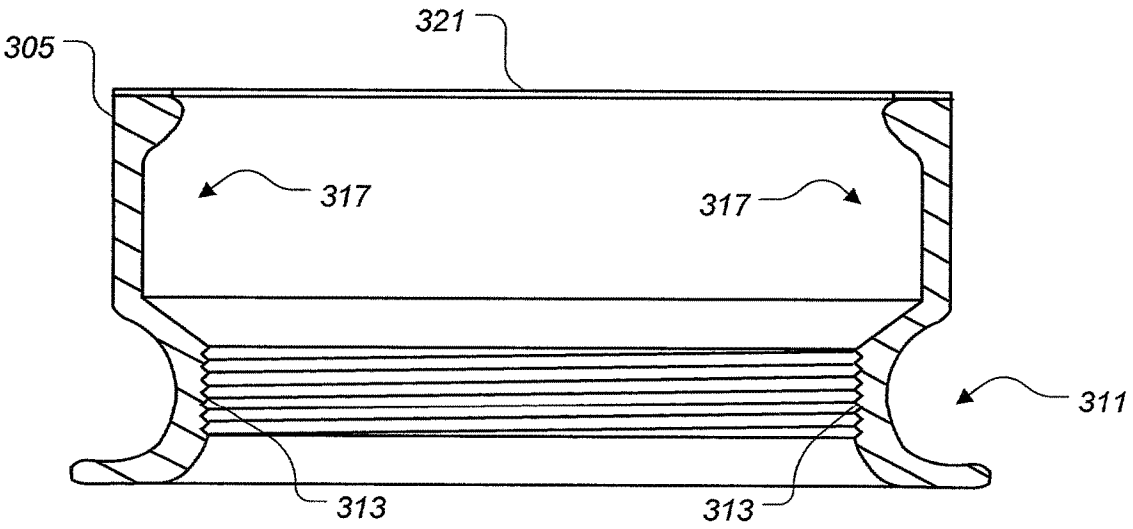
FIG. 3B is a cross section view of an outer ring for a portable air-tight water-tight reusable trash receptacle according to the present application.

Referring now to FIG. 3A, a perspective view of an outer ring for a portable air-tight water-tight reusable trash receptacle according to the present application is illustrated. Referring now also to FIG. 3B a cross section view, taken at line IIIB, of an outer ring for a portable air-tight water-tight reusable trash receptacle according to the present application is illustrated. Outer ring 305 is similar to that of outer ring 109. Outer ring 305 features tabs 309 for securing a lid. Tabs 309 use protrusions 315 to lock the lid 205 in place. In an alternative embodiment the outer ring 305 is threaded to couple to a lid. Additionally outer ring 305 includes a notch 311 configured for receiving an elastic strap of a fabric cover and thereby securing the fabric outer cover to the outer ring 305.

On an internal surface of the outer ring 305 is threading 313. Threading 313 is configured for coupling the outer ring 305 to an inner ring, such as inner ring 111. Recess 317 is located interior to the outer ring 305 and is configured such that an opening is produced when an inner ring and the outer ring 305 is coupled together. Recess 317 provides room for the excess edges of the liner. Additionally, recess 317 provides room for liner retention system. Liner retention system includes at least one of an elastic strap or Velcro strap to hold the liner to the inner ring. A seal 321, preferably rubber, is located on a top surface of the outer ring 305 to hold the liner in place, alternatively the outer ring 305 does not include a seal 321.

Figure 4A:
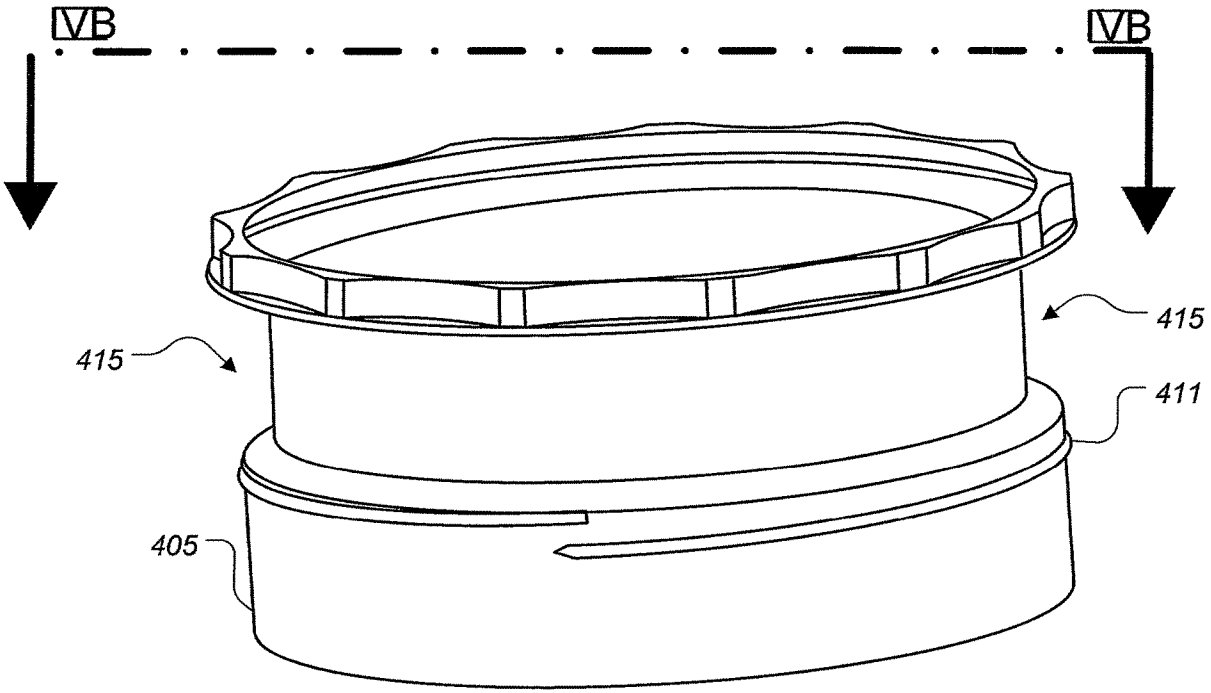
FIG. 4A is a perspective view of an inner ring for a portable air-tight water-tight reusable trash receptacle according to the present application.
Figure 4B:
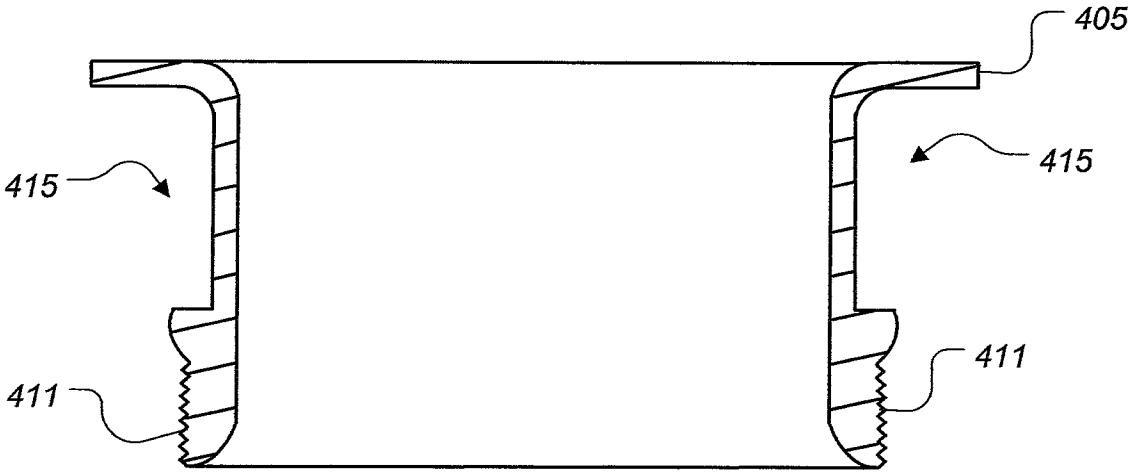
FIG. 4B is a cross section view of an inner ring for a portable air-tight water-tight reusable trash receptacle according to the present application.

Referring now to FIG. 4A, a perspective view of an inner ring for a portable air-tight water-tight reusable trash receptacle according to the present application is illustrated. Referring now also to FIG. 4B a cross section view, taken at line IVB, of an inner ring for a portable air-tight water-tight reusable trash receptacle according to the present application is illustrated. Inner ring 405 is similar to that of inner ring 111. An external surface of inner ring 405 is threaded 411 such that the inner ring can couple to the outer ring. Recess 415 provides room for the excess edges of the liner or trash bag. Inner ring preferably has an inner diameter of at least 90 mm to provide room for a diaper to be disposed. Additionally, recess 415 provides room for a liner retention system. Liner retention system includes at least one of an elastic strap or Velcro strap to hold the liner to the inner ring 405.

Figure 5:
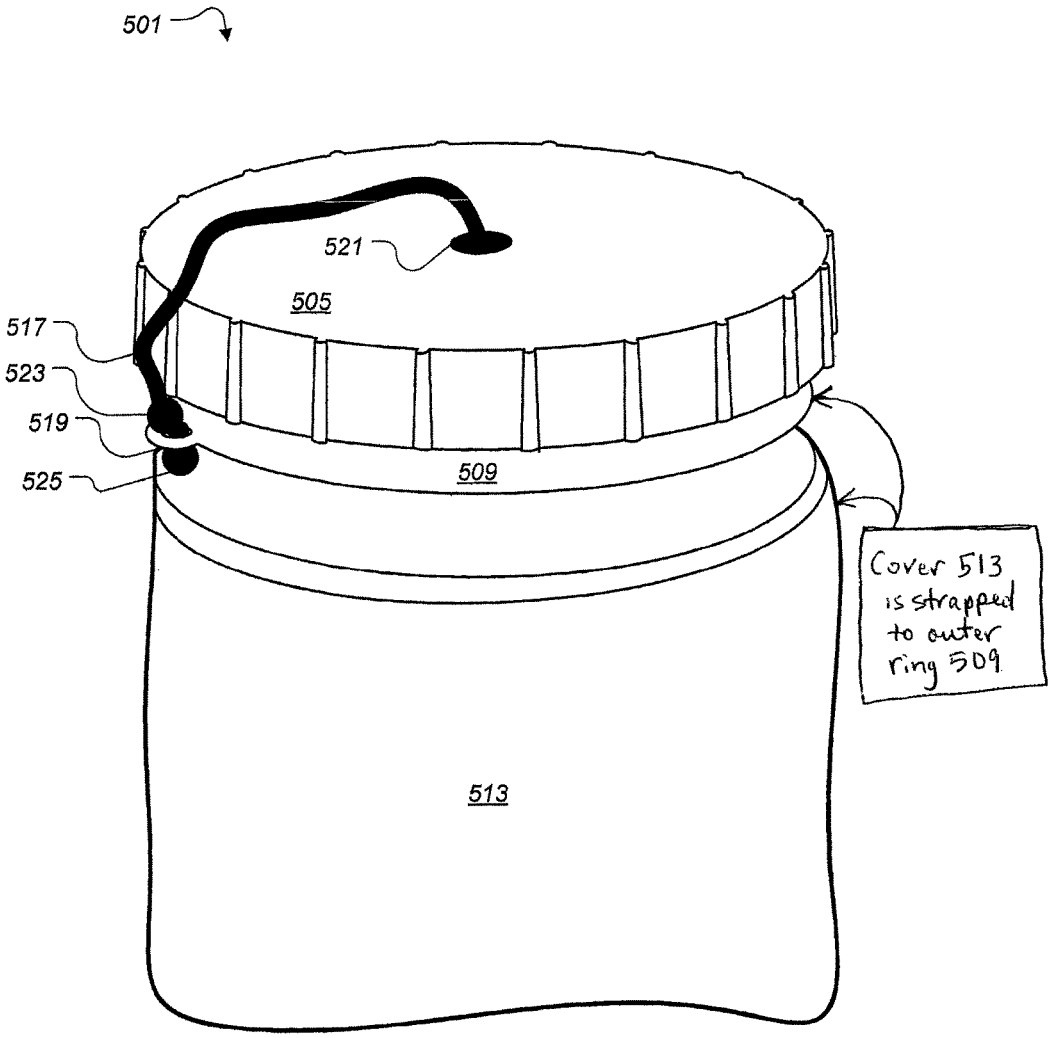
FIG. 5 is a perspective view of an alternative embodiment of a portable air-tight water-tight reusable trash receptacle according to the present application.

Referring now to FIG. 5, a perspective view of a portable air-tight water-tight reusable trash receptacle with a tethered lid according to the present application is illustrated. Trash receptacle 501 is comprised of a tethered lid 505, a tabbed outer ring 509, and an inner ring. A trash bag or liner is located between the outer ring 509 and the inner ring 511. Cover 513, preferably fabricated from an opaque fabric, is secured to the outer ring 509 with an elastic strap and hides the contents of the trash bag within. Cover 513 has a Velcro seam along the top portion to allow the cover 513 to expand over the lower portion of the outer ring 509. Tether 517 is attached between a tab 519 on the outer ring 509 and the lid 505. Tether 517 is an integral extension of rubber seal 217. Tether 517 uses an extended piece of rubber formed off of the rubber seal to secure the lid. Located on the end of the tether 517 nearest the lid is a first stop 521. First stop 521 is disc shaped. Lid 505 is held between the first stop 521 and the rubber seal. A diameter of the first stop is larger than a diameter of a hole though the lid 505 to prevent the extended piece of the tether from falling through the hole in the lid. A second stop 523 and a third stop 525 are located on the far end of the extended piece of the tether 517. Second stop and third stop are spherical in shape and are configured to hold the opening of tab 519 between the second and third stops. Tethering the lid to the rest of the receptacle prevents the lid from being lost. Losing the lid prevents the receptacle from being water-tight.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A trash receptacle for securing trash, comprising:
an outer ring;
an inner ring threadingly coupled to the outer ring;
a lid configured to be coupled to the outer ring;
a tether connecting the lid to the trash receptacle;
a gasket located inside the lid; and
a cover, comprised of fabric;
wherein the cover is strapped to the outer ring; and
wherein a trash bag is located between the outer ring and the inner ring so that trash can be inserted into the trash bag when the lid is removed from the outer ring.

* * * * *